US008695128B1

(12) United States Patent
Busbey

(10) Patent No.: US 8,695,128 B1
(45) Date of Patent: Apr. 15, 2014

(54) ADJUSTABLE RETURN FITTING

(76) Inventor: Richard Jeffrey Busbey, Panola, TX (US)

( * ) Notice: Subject to any disclaimer, the term of this patent is extended or adjusted under 35 U.S.C. 154(b) by 751 days.

(21) Appl. No.: 12/930,535

(22) Filed: Jan. 10, 2011

(51) Int. Cl.
*E04H 4/00* (2006.01)

(52) U.S. Cl.
USPC ..... 4/507

(58) Field of Classification Search
USPC ..... 4/507, 514.1, 541.6
See application file for complete search history.

(56) References Cited

U.S. PATENT DOCUMENTS

| | | | | |
|---|---|---|---|---|
| 2,817,489 | A | 12/1957 | Hesmer | |
| 3,938,553 | A | 2/1976 | Ortega | |
| 4,339,110 | A | 7/1982 | Ortega | |
| 5,095,558 | A | 3/1992 | Howard | |
| 5,414,878 | A | 5/1995 | Booth | |
| 5,681,025 | A | 10/1997 | Kuhn et al. | |
| 5,862,543 | A | 1/1999 | Reynoso et al. | |
| 6,578,207 | B1 * | 6/2003 | Fratilla | 4/492 |
| D478,653 | S | 8/2003 | Fratilla | |
| 6,959,690 | B1 | 11/2005 | Reynard | |
| 7,574,756 | B2 | 8/2009 | Tran | |
| 2011/0219531 | A1 * | 9/2011 | Walsh et al. | 4/507 |

* cited by examiner

*Primary Examiner* — Huyen Le
(74) *Attorney, Agent, or Firm* — R. Keith Harrison

(57) ABSTRACT

An adjustable return fitting includes a return fitting housing having a housing interior. A water jet adjustment dial including a dial body rotatably is carried by the return fitting housing and has a dial opening communicating with the housing interior of the return fitting housing. At least one dial tab is carried by the dial body. A baffle includes a baffle stem in the housing interior of the return fitting housing and has a main stem segment and a terminal stem segment extending from the main stem segment. The terminal stem segment is disposed within a rotational path of the at least one dial tab. A baffle disk is carried by the baffle stem in the housing interior of the return fitting housing.

20 Claims, 4 Drawing Sheets

ADJUSTABLE RETURN FITTING

FIELD

The disclosure generally relates to return fittings for swimming pools, spas and the like. More particularly, the disclosure relates to an adjustable return fitting which can be adjusted to select the force of a water jet directed into a pool, spa or the like.

BACKGROUND

A conventional swimming pool includes a pump and filter assembly having an inlet which is connected to one or multiple drains in the bottom of the pool. An outlet of the pump and filter assembly is connected to multiple return fittings provided at intermittent spacing with respect to each other in the sides of the pool. The pump and filter assembly draws water from the pool, filters the water and returns the water through the multiple return fittings in the sides of the pool. Spas, or "hot tubs", may be fitted with a similar arrangement to filter the water in the spa.

Conventional return fittings in swimming pools and spas are typically not adjustable such that the force of the water jet which is ejected from the return fittings into the pool or spa is not selectable.

SUMMARY

The disclosure is generally directed to an adjustable return fitting. An illustrative embodiment of the adjustable return fitting includes a return fitting housing having a housing interior. A water jet adjustment dial includes a dial body rotatably carried by the return fitting housing and having a dial opening communicating with the housing interior of the return fitting housing. At least one dial tab is carried by the dial body. A baffle includes a baffle stem in the housing interior of the return fitting housing and has a main stem segment and a terminal stem segment extending from the main stem segment. The terminal stem segment is disposed within a rotational path of the at least one dial tab. A baffle disk is carried by the baffle stem in the housing interior of the return fitting housing.

BRIEF DESCRIPTION OF THE DRAWINGS

The disclosure will now be made, by way of example, with reference to the accompanying drawings, in which.

DETAILED DESCRIPTION

Figure 1:
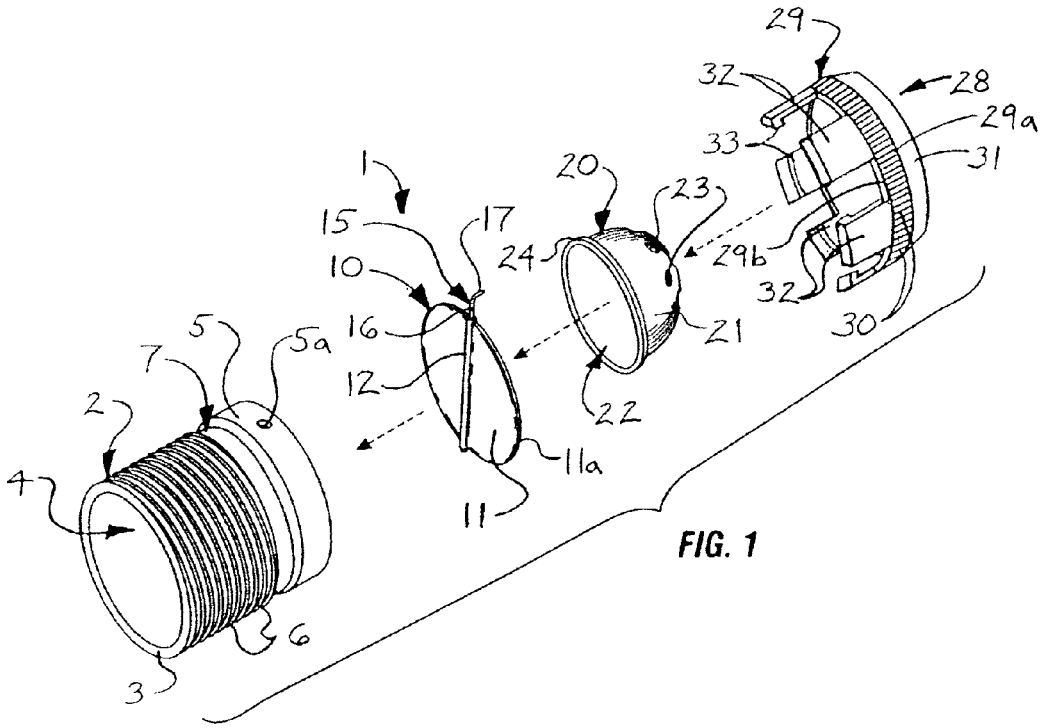
FIG. 1 is an exploded perspective view of an illustrative embodiment of the adjustable return fitting.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the invention and are not intended to limit the scope of the invention, which is defined by the claims. Furthermore, there is no intention to be bound by any expressed or implied theory presented in the preceding technical field, background, brief summary or the following detailed description.

Referring initially to FIGS. 1-9 of the drawings, an illustrative embodiment of the adjustable return fitting is generally indicated by reference numeral 1. The adjustable return fitting 1 includes a return fitting housing 2 having a housing wall 3 which may be generally elongated and cylindrical. The return fitting housing 2 may have a housing interior 4. A housing collar 5 may be provided on the exterior of the housing wall 3 at one end of the return fitting housing 2. Housing threads 6 may be provided on the exterior of the housing wall 3. An annular washer seat 7 may be provided on the exterior of the return fitting housing 2 between the housing collar 5 and the housing threads 6. The return fitting housing 2 may be PVC (polyvinylchloride) or other material which is consistent with the functional requirements of the adjustable return fitting 1.

Figure 4:
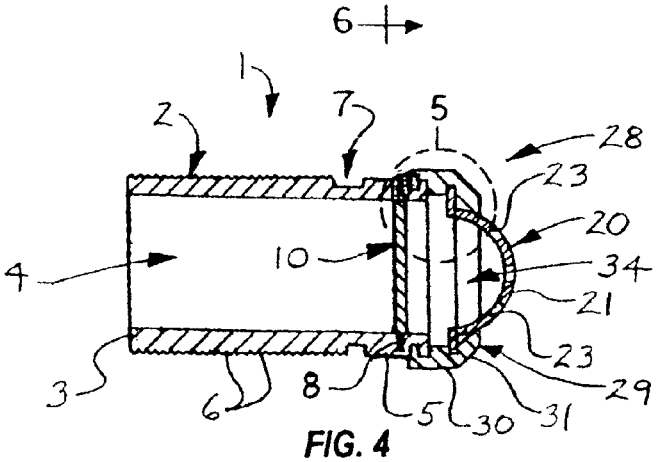
FIG. 4 is a longitudinal sectional view of an illustrative embodiment of the adjustable return fitting.
Figure 5:
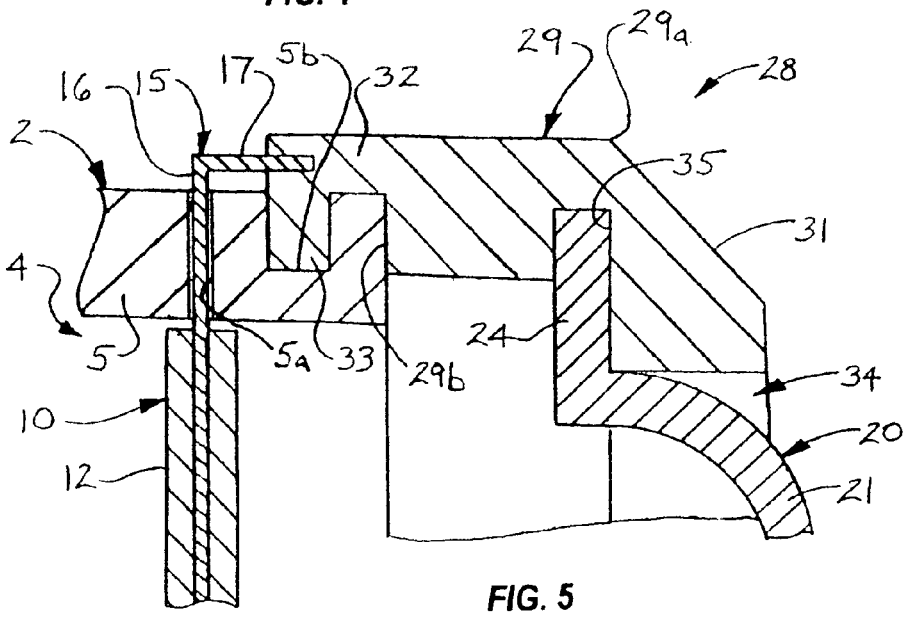
FIG. 5 is an enlarged sectional view, taken along section line 5 in FIG. 4.

A positionally-adjustable baffle 10 may be provided in the housing interior 4 of the return fitting housing 2. As illustrated in FIG. 1, the baffle 10 may have a circular baffle disk 11 with a baffle disk edge 11*a*. The baffle disk 11 of the baffle 10 may have a diameter which generally corresponds to or is slightly smaller than the diameter of the housing interior 4 of the return fitting housing 2. A baffle stem 15 may extend radially from the baffle disk edge 11*a* of the baffle plate 11. In some embodiments, the baffle stem 15 may include a generally elongated main stem segment 16 which may be attached to the baffle plate 11 as will be hereinafter described. A terminal stem segment 17 may extend from one end of the main stem segment 16. As illustrated in FIG. 5, the terminal stem segment 17 may be disposed at generally a 90-degree angle with respect to the longitudinal axis of the main stem segment 16. As further illustrated in FIG. 5, the main stem segment 16 may extend from the housing interior 4 of the return fitting housing 2 through a baffle stem opening 5*a* in the housing collar 5 of the return fitting housing 2. The terminal stem segment 17 may protrude from the main stem segment 16 at the exterior of the return fitting housing 2 for purposes which will be hereinafter described. As illustrated in FIG. 4, the lower end of the main stem segment 16 may be seated in a stem seat 8 provided in the interior surface of the return fitting housing 2. Accordingly, the main stem segment 16 of the baffle stem 15 may pivotally or rotatably mount the baffle disk 11 of the baffle 10 in the housing interior 4 of the return fitting housing 2 at the baffle stem opening 5*a* and the stem seat 8.

A water jet adjustment dial 28 may be rotatably mounted with respect to the housing collar 5 of the return fitting housing 2. The water jet adjustment dial 28 may include an annular dial body 29 having a first dial body edge 29*a* and a second dial body edge 29*b*. In some embodiments, finger grip ridges 30 (FIG. 3) may be provided in the exterior surface of the dial body 29. A dial bevel 31 may protrude from the first dial body edge 29*a* of the dial body 29. A dial opening 34 (FIG. 5) may extend through the dial body 29 and the dial bevel 31.

Figure 2:
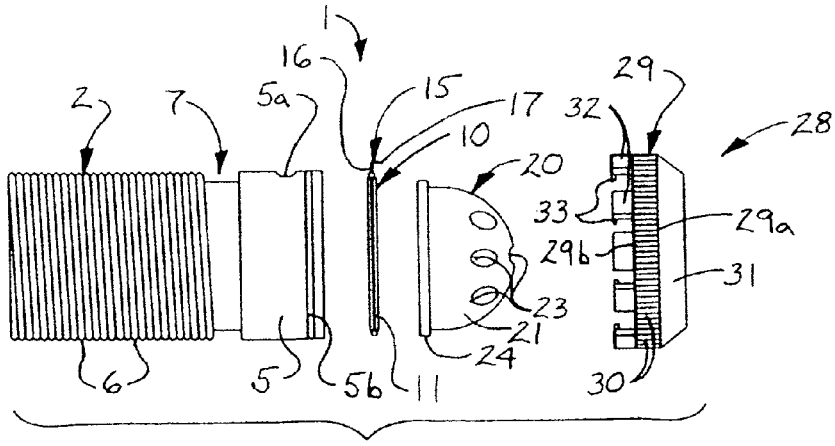
FIG. 2 is an exploded side view of an illustrative embodiment of the adjustable return fitting.
Figure 3:
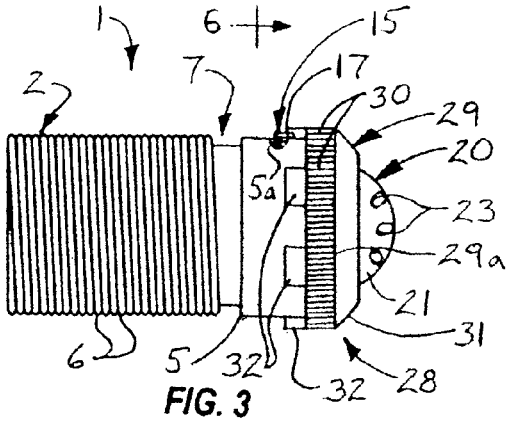
FIG. 3 is a side view of an illustrative embodiment of the adjustable return fitting.

At least one dial tab 32 may extend from the second dial body edge 29*b* of the dial body 29 for purposes which will be hereinafter described. In some embodiments, multiple dial tabs 32 may extend from the second dial body edge 29*b* in spaced-apart relationship to each other around the circumference of the dial body 29, as illustrated in FIGS. 1 and 2. The water jet adjustment dial 28 may be rotatably mounted with respect to the return fitting housing 2 according to any suitable technique known by those skilled in the art. In some embodiments, a tab finger 33 may protrude inwardly from the extending or distal end of each dial tab 32. A circumferential tab finger groove 5*b* (FIG. 2) may be provided in the exterior surface of the housing collar 5 of the return fitting housing 2. Accordingly, as illustrated in FIG. 5, the tab finger 33 of each dial tab 32 may be inserted in the tab finger groove 5*b* in the housing collar 5 to rotatably mount the water jet adjustment dial 28 on the housing collar 5 of the return fitting housing 2. It will be recognized and understood that alternative techniques known by those skilled in the art may be used to rotatably mount the water jet adjustment dial 28 on the return fitting housing 2. As further illustrated in FIG. 5, a circumferential eyeball fitting slot 35, the purpose of which will be hereinafter described, may be provided in the interior surface of the dial body 29 in the dial opening 34.

Figure 6:
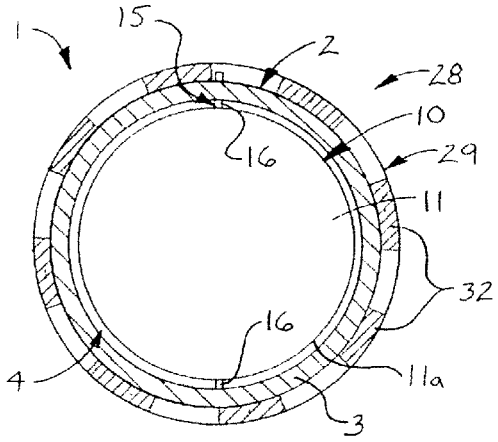
FIG. 6 is a cross-sectional view, taken along section lines 6-6 in FIG. 3, of an illustrative embodiment of the adjustable return fitting, with a baffle element of the fitting disposed in a water-impeding position.
Figure 7:
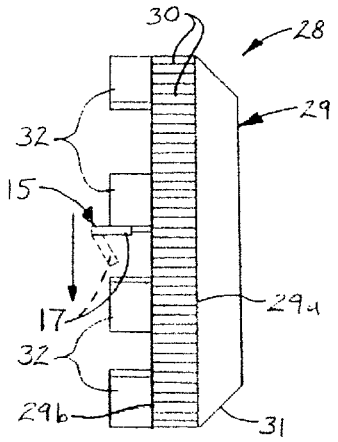
FIG. 7 is a side view of a water jet adjustment dial of an illustrative embodiment of the adjustable return fitting, with a baffle stem of the baffle shown in a position which corresponds to the water-impeding position illustrated in FIG. 6.
Figure 8:
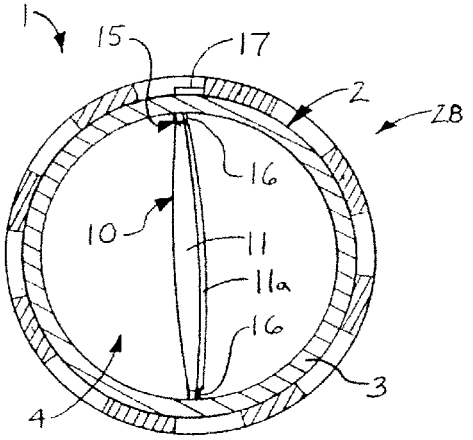
FIG. 8 is a cross-sectional view, taken along section lines 6-6 in FIG. 3, of an illustrative embodiment of the adjustable return fitting, with a baffle element of the fitting disposed in a water-flowing position.
Figure 9:
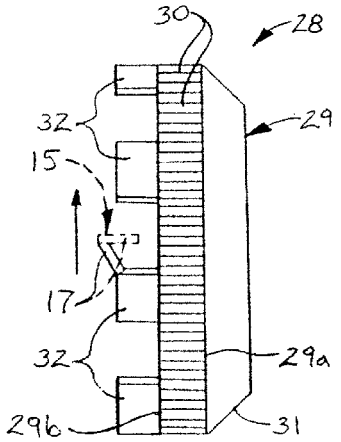
FIG. 9 is a side view of a water jet adjustment dial of an illustrative embodiment of the adjustable return fitting, with a baffle stem of the baffle shown in a position which corresponds to the water-flowing position illustrated in FIG. 8.

As illustrated in FIGS. 7 and 9, the terminal stem segment 17 of the baffle stem 15 on the baffle 10 may be disposed within the rotational path of the dial tabs 32 on the water jet adjustment dial 28. Accordingly, as illustrated in solid lines in FIG. 7, when the terminal stem segment 17 of the baffle stem 15 extends straight into the rotational path of the dial tabs 32, the baffle 10 may be oriented in the flow-impeding position in the housing interior 4 of the return fitting housing 2, as illustrated in FIG. 6. In the flow-impeding position, the baffle 10 maximally impedes the flow of water through the housing interior 4 of the return fitting housing 2 for purposes which will be hereinafter described. Rotation of the water jet adjustment dial 28 in a first direction on the return fitting housing 2, as indicated by the arrow in FIG. 7, causes one of the dial tabs 32 to first engage and then push the terminal stem segment 17 in the direction of rotation of the water jet adjustment dial 28, as illustrated in phantom in FIG. 7 and in solid lines in FIG. 9. This action rotates or pivots the main stem segment 16 and the baffle 10 such that the baffle 10 assumes the flow-facilitating position illustrated in FIG. 8. In the flow-facilitating position, the baffle 10 imparts minimal imposition to the free flow of water through the housing interior 4 of the return fitting housing 2 for purposes which will be hereinafter described. Rotation of the water jet adjustment dial 28 in a second direction on the return fitting housing 2, as indicated by the arrow in FIG. 9, causes one of the dial tabs 32 to engage and push the terminal stem segment 17 of the baffle stem 15 back to the original position illustrated in phantom in FIG. 9 and in solid lines in FIG. 7. This action rotates or pivots the main stem segment 16 of the baffle stem 15 and returns the baffle 10 back to the flow-impeding position illustrated in FIG. 6. It will be appreciated by those skilled in the art that the water jet adjustment dial 28 can be selectively rotated in such a manner that the terminal stem segment 17 is located at any position between that of FIG. 7 and that of FIG. 9 to achieve a continuum of flow-impeding capability of the baffle 10 between the maximal impeding position illustrated in FIG. 6 and the minimal impeding position illustrated in FIG. 8.

In some embodiments, an eyeball fitting 20 may be fitted in the dial opening 34 of the water jet adjustment dial 28. The eyeball fitting 20 may include a generally dome-shaped eyeball fitting body 21 having an eyeball fitting interior 22 (FIG. 1). At least one water jet opening 23 may be provided in the eyeball fitting body 21. In some embodiments, multiple water jet openings 23 may be provided in a selected pattern in the eyeball fitting body 21, as illustrated. An eyeball fitting rim 24 may extend outwardly from the edge of the eyeball fitting body 21. As illustrated in FIG. 5, the eyeball fitting 20 may be mounted in the dial opening 34 of the water jet adjustment dial 28 by inserting the eyeball fitting rim 24 in the circumferential eyeball fitting slot 35 in the interior surface of the dial body 29. As illustrated in FIG. 4, the eyeball fitting body 21 may protrude from the dial opening 34 of the water jet adjustment dial 28.

Figure 10:
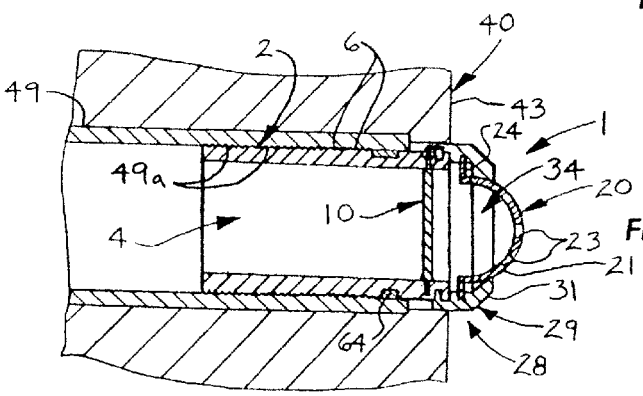
FIG. 10 is a longitudinal sectional view of an illustrative embodiment of the adjustable return fitting, installed in a side of a swimming pool (partially in section)
Figure 11:
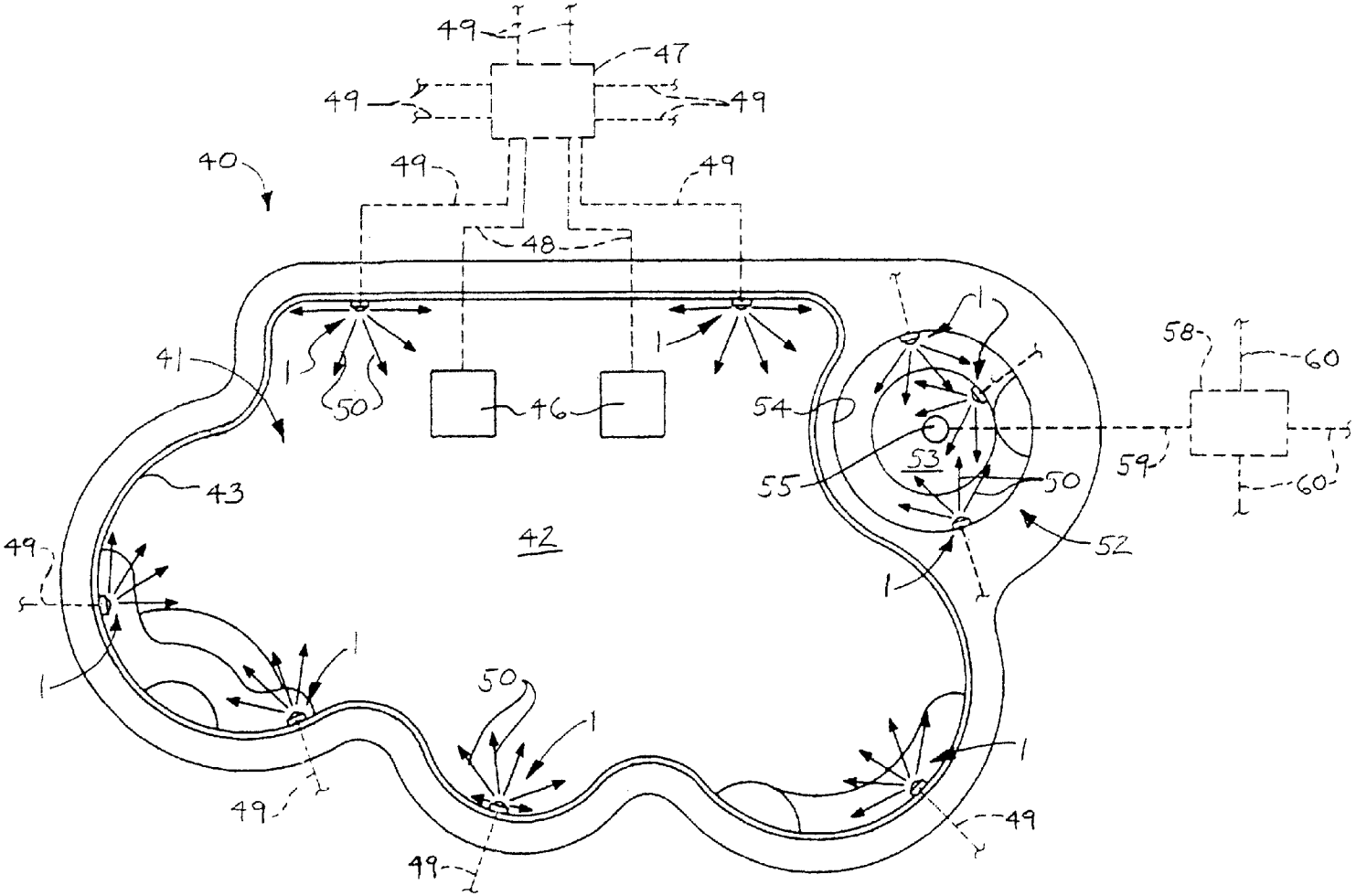
FIG. 11 is a top view of a swimming pool and a spa adjacent to the swimming pool, with multiple return fittings according to the disclosure mounted in the side of the swimming pool and the spa, respectively.

Referring next to FIGS. 10 and 11 of the drawings, in exemplary application, multiple adjustable return fittings 1 may be installed in a swimming pool 40 to return water 50 to the swimming pool 40 after filtering of the water 50, as illustrated in FIG. 11. Each adjustable return fitting 1 may be selectively adjusted to select the strength or force of the water jet 50 which is ejected from that adjustable return fitting 1. The swimming pool 40 may have a conventional design with a swimming pool bottom 42 and a swimming pool side 43 which form a swimming pool interior 41. Multiple adjustable return fittings 1 may be provided in the swimming pool side 43 at spaced-apart intervals with respect to each other.

At least one pool drain 46 may be provided in the swimming pool bottom 42. At least one pool drain conduit 48 may be disposed in fluid communication with the pool drain or drains 46. A pool pump and filter assembly 47 may be disposed in fluid communication with the pool drain conduit or conduits 48.

Each adjustable return fitting 1 may be disposed in fluid communication with the pool pump and filter assembly 47 through a corresponding pool return conduit 49. As illustrated in FIG. 10, each pool return conduit 49 may have interior conduit threads 49*a* which threadably engage the exterior housing threads 6 on the return fitting housing 2 of the corresponding adjustable return fitting 1. A washer 64 may be seated in the washer seat 7 between the return fitting housing 2 and the interior surface of the pool return conduit 49. As further illustrated in FIG. 10, each adjustable return fitting 1 may be mounted in the swimming pool side 43 of the swimming pool 40 such that the dial body 29 and the dial bevel 31 of the water jet adjustment dial 28 protrude beyond the surface of the swimming pool side 43.

During operation of the pool pump and filter assembly 47, water 50 may be continually or intermittently distributed from the swimming pool 40 through the drains 46 and the respective pool drain conduits 48 to the pool pump and filter assembly 47. In the pool pump and filter assembly 47, impurities and contaminants (not illustrated) are removed from the water 50 typically in the conventional manner. After filtering, the pool pump and filter assembly 47 pumps the water 50 through the pool return conduits 49 to the respective adjustable return fittings 1. At each adjustable return fitting 1, the water 50 flows through the housing interior 4 (FIG. 10) of the return fitting housing 2 and the dial opening 34 in the water jet adjustment dial 28, respectively, and is ejected into the swimming pool 40 through the water jet opening or openings 23 in the eyeball fitting 20 as one or more water jets 50 (FIG. 11).

It will be appreciated by those skilled in the art that the baffle 10 can be selectively oriented in the housing interior 4 of the return fitting housing 2 to selectively vary the strength or force of the water jets 50 which are ejected through the water jet openings 23 of the eyeball fitting 20 into the swimming pool 40. By selective rotation of the water jet adjustment dial 28 of each adjustable return fitting 1, the baffle 10 may be selectively oriented in the housing interior 4 to the position illustrated in FIG. 6 in which the baffle 10 substantially blocks or impedes flow of water through the housing interior 4 and eliminates the water jets 50 or minimizes the force of the water in the water jets 50 which are ejected through the water jet opening or openings 23. Conversely, the baffle 10 may be selectively oriented in the housing interior 4 to the orientation illustrated in FIG. 8 in which the baffle 10 facilitates flow of water through the housing interior 4 and maximizes the force of the water in the water jets 50 ejected through the water jet opening or openings 23. The baffle 10 may be selectively oriented in the housing interior 4 to positions which are between the maximal flow-impeding orientation illustrated in FIG. 6 and the minimal flow-facilitating orientation illustrated in FIG. 8 to achieve a continuum of ejection force in the water jets 50 as they are ejected through the water jet opening or openings 23.

As further illustrated in FIG. 11, in some applications, multiple adjustable return fittings 1 may be provided in a spa or hot tub 52 to return water 50 from a hot tub pump and filter assembly 58. The hot tub 52 may be adjacent to the swimming pool 40, as illustrated, or separate from the swimming pool 40 and may include a hot tub bottom 53 and a hot tub side 54. A hot tub drain 55 may be provided in the hot tub bottom 53. The hot tub pump and filter assembly 58 may be disposed in fluid communication with the hot tub drain 55 through a hot tub drain conduit 59. The adjustable return fittings 1 may be provided in the hot tub side 54 at spaced-apart intervals with respect to each other. The adjustable return fittings 1 may be disposed in fluid communication with the hot tub pump and filter assembly 58 through respective hot tub return conduits 60.

Operation of the adjustable return fittings 1 in the hot tub 52 may be as was heretofore described with respect to the swimming pool 40. Accordingly, during operation of the hot tub 52, water 50 may be continually or intermittently distributed from the hot tub 52 through the hot tub drain 55 and the hot tub drain conduit 59, respectively, to the hot tub pump and filter assembly 58. The hot tub pump and filter assembly 58 filters the water 50 and pumps the water 50 back into the hot tub 52 through the hot tub drain conduits 60 and adjustable return fittings 1, respectively. By selective rotation of the water jet adjustment dial 28 (FIGS. 1-10) on the return fitting housing 2 of each adjustable return fitting 1, the orientation of the baffle 10 in the housing interior 4 of the return housing fitting 2 is adjusted to vary the force of the water jet or jets 50 which are ejected from each adjustable return fitting 1, as was heretofore described.

While the illustrative embodiments of the disclosure have been described above, it will be recognized and understood that various modifications can be made in the disclosure and the appended claims are intended to cover all such modifications which may fall within the spirit and scope of the disclosure.

What is claimed is:

1. An adjustable return fitting, comprising:
a return fitting housing having a housing interior;
a water jet adjustment dial including:
a dial body rotatably carried by said return fitting housing and having a dial opening communicating with said housing interior of said return fitting housing; and
at least one dial tab carried by said dial body;
a baffle including:
a baffle stem in said housing interior of said return fitting housing and having a main stem segment and a terminal stem segment extending from said main stem segment, said terminal stem segment disposed within a rotational path of said at least one dial tab; and
a baffle disk carried by said baffle stem in said housing interior of said return fitting housing.

2. The adjustable return fitting of claim 1 further comprising an eyeball fitting having at least one water jet opening provided in said dial opening of said dial body.

3. The adjustable return fitting of claim 2 wherein said at least one water jet opening comprises a plurality of water jet openings.

4. The adjustable return fitting of claim 2 wherein said eyeball fitting comprises a generally dome-shaped eyeball fitting body and wherein said at least one water jet opening extends through said eyeball fitting body.

5. The adjustable return fitting of claim 4 further comprising a circumferential eyeball fitting slot in said dial body and an eyeball fitting rim on said eyeball fitting body and inserted in said eyeball fitting slot.

6. The adjustable return fitting of claim 1 further comprising a baffle stem opening in said return fitting housing and wherein said baffle stem extends through said baffle stem opening.

7. The adjustable return fitting of claim 1 further comprising a plurality of finger grip ridges in said dial body of said water jet adjustment dial.

8. The adjustable return fitting of claim 1 further comprising a dial bevel protruding from said dial body of said water jet adjustment dial.

9. An adjustable return fitting, comprising:
a return fitting housing having a housing interior;
a water jet adjustment dial including:
a dial body rotatably carried by said return fitting housing and having a dial opening communicating with said housing interior of said return fitting housing; and
at least one dial tab carried by said dial body; and
a baffle including:
a baffle stem in said housing interior of said return fitting housing and having a main stem segment and a terminal stem segment extending from said main stem segment at a generally 90-degree angle with respect said main stem segment, said terminal stem segment disposed within a rotational path of said at least one dial tab; and
a baffle disk carried by said baffle stem in said housing interior of said return fitting housing.

10. The adjustable return fitting of claim 9 further comprising an eyeball fitting having at least one water jet opening provided in said dial opening of said dial body.

11. The adjustable return fitting of claim 10 wherein said at least one water jet opening comprises a plurality of water jet openings.

12. The adjustable return fitting of claim 10 wherein said eyeball fitting comprises a generally dome-shaped eyeball fitting body and wherein said at least one water jet opening extends through said eyeball fitting body.

13. The adjustable return fitting of claim 12 further comprising a circumferential eyeball fitting slot in said dial body and an eyeball fitting rim on said eyeball fitting body and inserted in said eyeball fitting slot.

14. The adjustable return fitting of claim 9 further comprising a baffle stem opening in said return fitting housing and wherein said baffle stem extends through said baffle stem opening.

15. The adjustable return fitting of claim 9 further comprising a plurality of finger grip ridges in said dial body of said water jet adjustment dial.

16. The adjustable return fitting of claim 9 further comprising a dial bevel protruding from said dial body of said water jet adjustment dial.

17. An adjustable return fitting, comprising:

a return fitting housing including:

a generally elongated, cylindrical housing wall forming a housing interior;

a housing collar in said housing wall;

an exterior circumferential tab finger groove in said housing collar; and a baffle stem opening extending through said housing collar;

a water jet adjustment dial including:

an annular dial body rotatably carried by said return fitting housing and having a first dial body edge, a second dial body edge and a dial opening communicating with said housing interior of said return fitting housing;

a dial bevel extending from said first dial body edge;

at least one dial tab carried by said second dial body edge; and at least one tab finger extending from said at least one dial tab and inserted in said tab finger groove in said return fitting housing; and a baffle including:

a baffle stem in said housing interior of said return fitting housing and having a main stem segment extending through said baffle stem opening in said housing wall and a terminal stem segment extending from said main stem segment at a generally 90-degree angle with respect said main stem segment, said terminal stem segment disposed within a rotational path of said at least one dial tab;

a baffle disk carried by said baffle stem in said housing interior of said return fitting housing; and an eyeball fitting having at least one water jet opening in said dial opening of said water jet adjustment dial.

18. The adjustable return fitting of claim 17 further comprising a plurality of housing threads on said housing wall of said return fitting housing.

19. The adjustable return fitting of claim 18 further comprising a washer seat between said housing threads and said housing collar.

20. The adjustable return fitting of claim 17 further comprising a plurality of finger grip ridges in said dial body of said water jet adjustment dial.

* * * * *